United States Patent [19]

Reynolds

[11] 3,982,217

[45] Sept. 21, 1976

[54] PRESSURE-OPERATED SWITCH

[75] Inventor: David E. Reynolds, Littleton, Colo.

[73] Assignee: Continental Oil Company, Ponca City, Okla.

[22] Filed: Apr. 14, 1975

[21] Appl. No.: 567,584

Related U.S. Application Data

[60] Continuation-in-part of Ser. No. 537,985, Jan. 2, 1975, which is a division of Ser. No. 459,151, April 8, 1974, Pat. No. 3,935,567.

[52] U.S. Cl. ..... 335/207; 200/81.9 M; 200/83 L; 335/205

[51] Int. Cl.[2] ..... H01H 85/02

[58] Field of Search ..... 200/81.9 M, 82 E, 83 B, 200/83 C, 83 D, 83 R, 83 L; 335/205, 207

[56] References Cited

UNITED STATES PATENTS

| | | | |
|---|---|---|---|
| 3,458,841 | 7/1969 | Davis | 335/207 |
| 3,608,472 | 9/1971 | Pelster et al. | 200/81.9 M X |
| 3,611,220 | 10/1971 | Hoffman | 200/81.9 M |
| 3,896,280 | 7/1975 | Blake | 200/81.9 M |

FOREIGN PATENTS OR APPLICATIONS

| | | | |
|---|---|---|---|
| 1,152,176 | 8/1963 | Germany | 200/83.6 |

*Primary Examiner*—J D Miller
*Assistant Examiner*—Fred E. Bell
*Attorney, Agent, or Firm*—William J. Miller

[57] ABSTRACT

A nonexplosive pressure-responsive switch has a housing containing a chamber which is exposed to a source of pressure and a second chamber containing switch elements. A partition separates the two chambers. The chamber connected to the pressure to be monitored has a longitudinal collapsible bellows mounted inside with a first magnet mounted on its end. In an unpressured condition the magnet will normally touch the partition between the chambers. The second chamber containing the switch elements also contains a second magnet which is mounted in an adjustable cylinder. A third magnet is mounted between the adjustable magnet and the switch contacts. When the first magnet is against the partition, the first magnet pulls the movable magnet in the second chamber against the switch contacts, and when the first magnet moves away from the partition, the adjustable magnet attracts the movable magnet, breaking the switch contacts. A second set of switch contacts can be carried by the adjustable magnet's housing.

7 Claims, 3 Drawing Figures

PRESSURE-OPERATED SWITCH

RELATED APPLICATIONS

Application Ser. No. 459,151 filed Apr. 8, 1974 now U.S. Pat. No. 3,935,567, by David E. Reynolds entitled "Leak Detection Apparatus" is related to this application. Application Ser. No. 567,669 filed Apr. 14, 1975 by David E. Reynolds is also related to this application.

This invention is a continuation in part of application Ser. No. 537,985, filed Jan. 2, 1975, entitled "Leak Detection Apparatus" by David E. Reynolds which in turn is a division of application Ser. No. 459,151 above referenced.

The divisional application discloses a pressure sensing switch which includes a nonferrous housing having a cylindrical opening in the housing to a depth less than the dimension of the housing. One end of the housing is closed. A cylindrical piston having a length less than the opening is slidably mounted in the opening. A magnet means is mounted on one end of the piston. A second opening is formed adjacent to the first opening, and a biasing means is adapted to urge the piston away from one end. A magnetic relay means is positioned in the second opening and adjacent to first opening and spaced to receive insufficient flux from the magnet to operate the relay when the cylinder is slid into the first opening and receives sufficient flux to operate the Reed relay when the piston has slid a measured distance away from said end.

The above system provides a relay which is explosion-proof since the chamber sensing the variation in pressure is completely isolated from the chamber containing the relay mechanism sensitive to variations in pressure in the first chamber.

BRIEF DESCRIPTION OF THE INVENTION

This invention contemplates an explosion-proof type relay which is pressure sensitive to an environment which may contain a highly explosive or flammable material. The relay essentially consists of a first and second chamber, each of which is axially aligned with each other. The first chamber contains a bellows which is completely sealed to its environment and filled with gas. On one end of the bellows closest the second chamber is mounted a magnet. In the second chamber, switch contacts are positioned so that a magnet which is slidably mounted in the second chamber will contact the switch contacts when the magnet attached to the bellows is closest to the end of the chamber. A third magnet is positioned in the second chamber so that when the magnet attached to the bellows moves away from the end closest to second chamber, the second magnet will move toward the first magnet, breaking the connection with the relay contacts. The invention also contemplates a second set of relay contacts mounted close to the third magnet so that when the second magnet moves from the relay contacts closest to the first magnet, it will contact the relay contacts closest to the third magnet. When pressure is applied to the first chamber, the bellows will collapse axially under the pressure, moving the first magnet away from the end and causing the second magnet to break contact and move toward the third magnet. Means are provided to adjust the positioning of the third magnet with respect to the end of the second chamber closest the first magnet so that the sensitivity of the system can be adjusted.

DETAILED DESCRIPTION OF THE FIGURES

Figure 1:
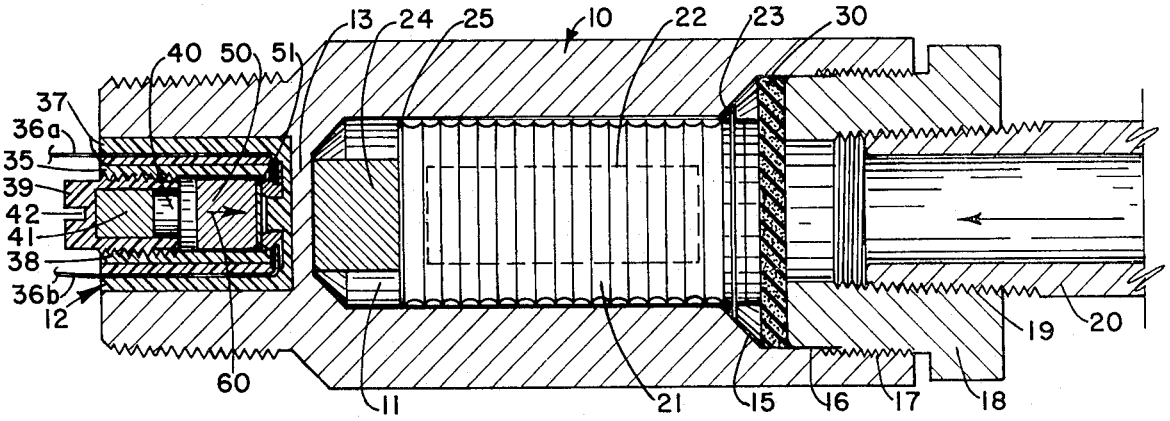
FIG. 1 is a cross-sectional view of a switch embodying the concepts of this invention wherein the system is in an unpressurized state.

Throughout the specification, similar numbers will be used for similar components. Referring to all of the figures but in particular to FIGS. 1 and 2, a substantially cylindrical housing 10 has a first axial chamber 11 bored into one end of cylindrical housing 10 and aligned with the axis of the housing. A second cylindrical chamber 12 is formed in the opposite end of housing 10 and axially aligned with chamber 11. A partition 13 is formed between chamber 11 and chamber 12 and is of a thickness sufficient to prevent a predetermined pressure in chamber 11 from breaking through into chamber 12. For example, if housing 10 is made of aluminum 2011, then the thickness of partition 13 will be 0.040 inch minimum in order to withstand 2,200 pounds per square inch in chamber 11. Chamber 11 further includes a chamfer 15 and a larger diameter portion 16. Threads 17 are formed in portion 16 to threadably secure a fitting 18. Threads 17 may be either pipe threads or any other well-known type threads which can seal against fluid or gaseous pressure. Fitting 18 can also include threads 19 which will secure a pipe 20 or other means for conveying fluid or pressure into chamber 11. Mounted inside chamber 11 is a pressure responsive means such as a bellows 21 which has a diameter slightly less than the inside diameter of chamber 11. Bellows 21 additionally includes a stop means 22 mounted inside bellows 21 and may, for example, be a cylinder of metal having a length sufficient to permit bellows 21 to collapse and yet not collapse to the extent it will damage the bellows. Bellows 21 is further sealed on each end by a disk (not shown) to trap air or gas inside the bellows at a predetermined pressure. An extension 23 is attached to bellows 21 at the inlet side to restrict the movement of bellows 21 into chamber 11. Extension 23 should be of sufficient size to engage the side of chamfer 15. Extension 23 can be metal pieces, a metal ring, or any suitable device to prevent the forward movement of the bellows into chamber 11. On the opposite end of the bellows 21 is attached a magnet 24 on end 25. Magnet 24 is any ordinary magnet and may, for example, be one of the ceramic type magnets well known in the art. The length of bellows 21 and magnet 24 is adjusted so that the bellows and magnet will be the same length as chamber 11 under normal atmospheric pressures. This distance, of course, is not critical but can be adjusted in accordance with the intended use of the device. Therefore, if extremely high pressures are contemplated, the length of the bellows and magnet combined can be in fact longer than chamber 11. It is also, in the embodiment shown, not necessary to actually secure extension 23 against movement away from chamfer 15. However, under some conditions, it may be preferred to actually anchor extension 23 against movement in any direction.

A filter means 30 is positioned between the end of fitting 18 and chamfer 15 in order to prevent entrapped material from entering into the bellows magnet area since entrapped material could prevent the bellows from closing or prevent the magnet from abutting partition 13. Referring to chamber 12, a cylindrical plastic insert 35 is positioned inside chamber 12 along with a pair of contacts 36A and 36B. Liquid plastic 37 is then flowed in around these contacts and permitted to harden in order to secure the contacts at insert 35. Inside insert 35 are threads 38 which provide a means for securing and adjusting a magnet holder 39. Holder 39 has a hollow interior 40 with a second magnet 41 forced into hollow interior 40. A screw type slot 42 is formed in the end of holder 39 and provides a means for adjusting the penetration of magnet holder 39 into cylindrical plastic insert 35. Positioned inside insert 35 between partition 13 and magnet 41 is a third magnet 50 which has a ring contact 51 attached at one end nearest contacts 36A and 36B.

OPERATION

Figure 2:
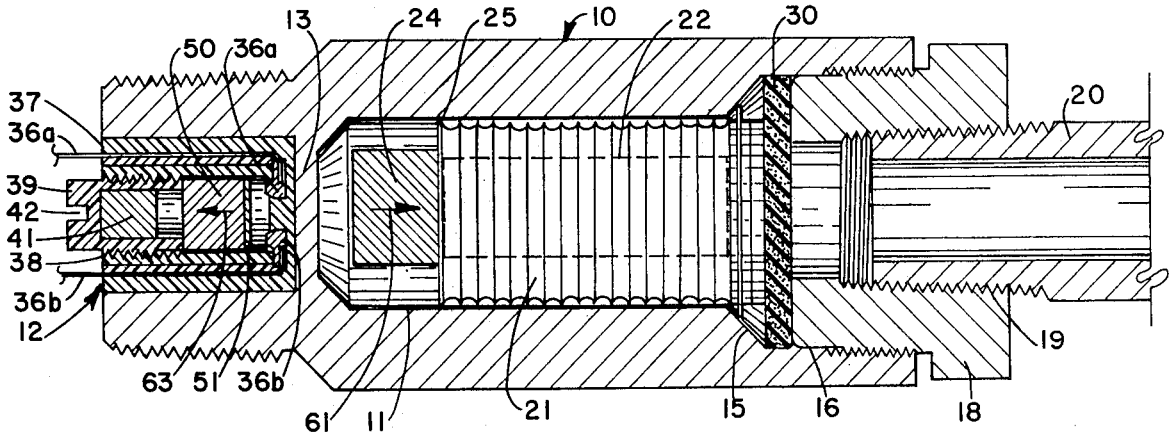
FIG. 2 is a cross-sectional view of the switch shown in FIG. 1 in a pressurized state; and, FIG. 3 illustrates a modification of the contacts shown in FIGS. 1 and 2.

Referring to FIGS. 1 and 2, the operation of the switch will be explained. FIG. 1 shows the switch in a depressurized condition, while FIG. 2 illustrates the switch in a pressurized condition. Referring first to FIG. 1, it can be shown that when insufficient pressure is in chamber 11, bellows 21 is extended to its full length, and magnet 24 is abutting partition 13. Under these conditions, magnet 50 will be attracted by magnet 24, causing magnet 50 to move in the direction of arrow 60, making contact with contacts 36A and 36B with ring contact 51. The circuit will then be completed through the contacts.

Referring to FIG. 2, when pressure is increased in chamber 11, bellows 21 will collapse, causing magnet 24 to move away from partition 13 in the direction of arrow 61. When the above occurs, magnet 50 will move in the direction of arrow 63 since it is being attracted at this point by magnet 41. When it moves in the direction of arrow 63, contacts 36A and 36B will disconnect from ring contact 51. The particular embodiment constructed in accordance with the above will open its contacts upon a pressure of 12 psi and will close its contacts when the pressure drops to 10 psi.

Figure 3:
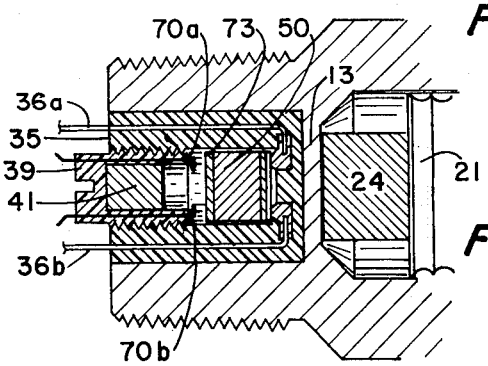

Referring to FIG. 3, a modified embodiment of the device shown in FIGS. 1 and 2 is illustrated. In this modification, a second set of contacts 70A and 70B are provided in magnet holder 39. A second ring contact 73 is mounted at the opposite end of magnet 50 and provides the means for completing the circuit between contacts 70A and 70B.

Adjustable magnet holder 39 provides a method for setting the sensitivity of the opening and closing of this system. For example, if holder 39 is rotated to move holder 39 inwardly, magnet 41 will move closer to magnet 50, thereby providing an increased pull on magnet 50. Thus, as magnet 24 moves away in the direction of arrow 61 (see FIG. 2), less movement will be required to cause magnet 50 to operate in the direction of arrow 63 as shown in FIG. 2. Conversely, if the magnet holder 39 is rotated in the opposite direction moving it out and away from magnet 50, then more movement of magnet 24 will be needed in the direction of arrow 61 in order to cause magnet 50 to move in the direction of arrow 63 toward magnet 41.

The preferred embodiment of this invention is made as previously mentioned of aluminum. Other nonferrous or plastic materials, of course, can be used, such as brass, and still be well within the scope of this invention as intended by the specification and appended claims.

Modification and changes can be made in the contacts and in the method of positioning the magnets and adjusting the magnets and still be within the scope of this invention.

What I claim is:

1. A pressure-responsive switch comprising:

a. a housing;

b. first and second axially aligned chambers formed in said housing and separated by a partition;

c. pressure-responsive means extending into said second chamber;

d. a first magnet means attached to said pressure-responsive means so that, when unpressured, said first magnet means is in contact with said partition;

e. a contact means mounted in said first chamber;

f. a second magnet means rigidly mounted in said first chamber;

g. a third magnet means slidably mounted in said first chamber between said partition and said second magnet means; and h. a second contact means carried by said third magnet in a manner to mate with said first-mentioned contact means.

2. A switch as described in claim 1 wherein said first-mentioned contact means is mounted next to said partition whereby said second contact means mates with said first-mentioned contact means when said first magnet means is in contact with said partition and breaks with said first-mentioned contact means when said first magnet means moves away from partition by a predetermined distance.

3. A switch as described in claim 1 wherein said second magnet means is rigidly mounted in a nonferric cylinder and wherein said cylinder is axially adjustable to or away from said partition.

4. A switch as described in claim 1 wherein said pressure-responsive means comprises a cylindrical bellows having closed ends and wherein said first magnet means is attached to one end and wherein said second end carries a stop means to locate said cylindrical bellows in said second chamber.

5. A switch as described in claim 3 wherein said first-mentioned contact means is mounted in said nonferric cylinder and wherein said second contact means is mounted on said third magnet means to break with said first-mentioned contact means when said first magnet means is in contact with said partition and to mate with said first-mentioned contact means when said first magnet means is moved away from said partition.

6. A switch as described in claim 3 wherein said first-mentioned contact means comprises a first pair of spaced contacts mounted adjacent said partition and a second pair of spaced contacts mounted in said nonferric cylinder; and wherein said second contact means comprises first and second contacts mounted to said third magnet means to mate with said first or second contacts, respectfully.

7. A switch as described in claim 6 wherein said pressure-responsive means comprises a cylindrical bellows which is formed to collapse axially under pressure.

* * * * *